US007201007B2

(12) United States Patent
Shoukyuu et al.

(10) Patent No.: US 7,201,007 B2
(45) Date of Patent: Apr. 10, 2007

(54) AUTOMATIC ICE MAKING DEVICE

(75) Inventors: Masatoshi Shoukyuu, Kusatsu (JP); Ichiro Onishi, Shiga (JP)

(73) Assignee: Matsushita Electric Industrial Co., Osaka (JP)

( * ) Notice: Subject to any disclaimer, the term of this patent is extended or adjusted under 35 U.S.C. 154(b) by 108 days.

(21) Appl. No.: 11/013,035

(22) Filed: Dec. 15, 2004

(65) Prior Publication Data

US 2005/0138937 A1 Jun. 30, 2005

(51) Int. Cl.
*F25C 1/12* (2006.01)

(52) U.S. Cl. ..... 62/137; 62/353

(58) Field of Classification Search ..... 62/135, 62/137, 351, 353

See application file for complete search history.

(56) References Cited

U.S. PATENT DOCUMENTS 4,649,717 A * 3/1987 Tate et al. ..... 62/340
4,665,708 A * 5/1987 Tate et al. ..... 62/66
6,334,318 B1 1/2002 Ando et al.

FOREIGN PATENT DOCUMENTS

JP 06-323705 11/1994
JP 2000-292042 10/2000
JP 2003-343951 12/2003

OTHER PUBLICATIONS

Japanese Search Report for PCT/JP2004/018994 dated Apr. 19, 2005.
English translation of Form PCT/ISA/210.

* cited by examiner

*Primary Examiner*—William E. Tapolcai
(74) *Attorney, Agent, or Firm*—RatnerPrestia

(57) ABSTRACT

The automatic ice making device includes ice sensor for detecting ice-making in ice chill tray, heater for heating ice to separate the ice from ice chill tray, motor rotating discharging member for discharging ice from ice chill tray, position detecting switch for detecting rotating position of discharging member, ice storage amount detecting switch for detecting overs and shorts of discharged and stored ice, water supply valve for supplying water to ice chill tray, and controller for controlling electric conduction to heater and motor. When power supply to controller is once interrupted and re-started, ice storage amount detecting switch detects shortage of ice so as to hold motor not to drive until ice sensor detects temperature below a predetermined temperature.

2 Claims, 4 Drawing Sheets

AUTOMATIC ICE MAKING DEVICE

FIELD OF THE INVENTION

The present invention relates to an automatic ice making device to be disposed in a refrigeration room of such as a refrigerator, and cooled after supplying water for making ice.

BACKGROUND OF THE INVENTION

In a conventional automatic ice making device, a thermistor furnished to an ice chill tray detects judgment that water has been frozen, and a microcomputer controls an ice discharging operation, as disclosed in, for example, Patent Laid Open No. 2000-292042.

In the following description, with reference to the attached drawings, explanation will be made to the above mentioned conventional ice chill tray.

FIG. 4 is a system-block diagram of the conventional automatic ice making device. In the same, this conventional automatic ice making device is provided with electric heater 1 furnished to an ice chill tray for separating ice, AC motor 2 for discharging ice, solenoid valve 3 for pouring water, thermistor 4 for detecting temperature of the ice chill tray, switch 5 for detecting ice of a predetermined amount stored in an ice bucket, triacs 91 to 93 for controlling electric conduction to heater 1, motor 2 and solenoid valve 3, microcomputer 6, gate drive circuit 7 for outputting gate signals of respective triacs 91 to 93, DC power source circuit 8 of outputting 5V voltage, and thermal fuse 10 working at overheating of triacs 91 to 93 and the ice chill tray.

The ice chill tray structured as above mentioned will be explained in operation.

Microcomputer 6 reads in output voltage of thermistor 4, and when a detected temperature goes down to, for example, around −5°, it turns ON triac 93 for a determined time (for example, 4 seconds) via gate drive circuit 7. If turning ON triac 93, solenoid valve 3 opens to pour water into ice chill tray 3.

Microcomputer 6 then detects the ice-making, and turns ON triacs 91, 92 via gate drive circuit 7. Electric heater 1 is heated and AC motor 2 is driven.

If pawls of ice discharging mechanism contact ice in company with rotation of AC motor 2, AC motor 2 is locked. After awhile, the temperature of the ice chill tray goes up by electric heater 1, portions of ice contacting the ice chill tray begin melting, and ice separates from the ice chill tray. Ice is discharged from the ice chill tray by rotation of AC motor 2. When the ice-discharge is completed, conduction to electric heater 1 is stopped, and pawls of the ice discharging mechanism are held at a predetermined position. By the above series of operations, one cycle of the ice making work is finished.

However, with the above mentioned mechanism, in case the power supply is interrupted by such as interruption of power supply, and the power supply is recovered immediately after ice in the ice chill tray melts and becomes water, and in spite of still presence of water in the ice chill tray, if the thermistor detects a predetermined temperature, water is further supplied. Water therefore possibly overflows from the ice chill tray.

All of electric heater 1, AC motor 2 and solenoid valve 3 are controlled by the microcomputer, so that the control part will be at high cost.

SUMMARY OF THE INVENTION

In view of the above problem, the present invention is to provide an automatic ice making device, aiming at low cost in the control part without oversupplying water into the ice chill tray and spoiling ice-making capacity.

The automatic ice making device of the invention is provided with an ice chill tray;

an ice sensor for detecting generation of ice in the ice chill tray;

a heater for heating the ice chill tray for separating ice from the ice chill tray;

a motor for rotating a discharging member of discharging ice separated from the ice chill tray;

a position detecting switch for detecting rotating position of the discharging member;

an ice storage amount detecting switch for detecting the amount of ice discharged from the ice chill tray and stored;

a water supply valve for supplying water to the ice chill tray, and a controller for controlling conduction to the motor and the heater, and controlling the water supply valve.

The controller drives the motor when the ice storage amount detecting switch detects that the amount of the stored ice is below the predetermined amount and the ice sensor detects temperature under the predetermined temperature.

DETAILED DESCRIPTION OF THE EXEMPLARY EMBODIMENTS

In the following description, explanation will be made to the embodiment of the ice chill tray according to the invention, referring to the attached drawings. It should be noted that the present invention is not limited by this embodiment.

Embodiment 1

Figure 1:
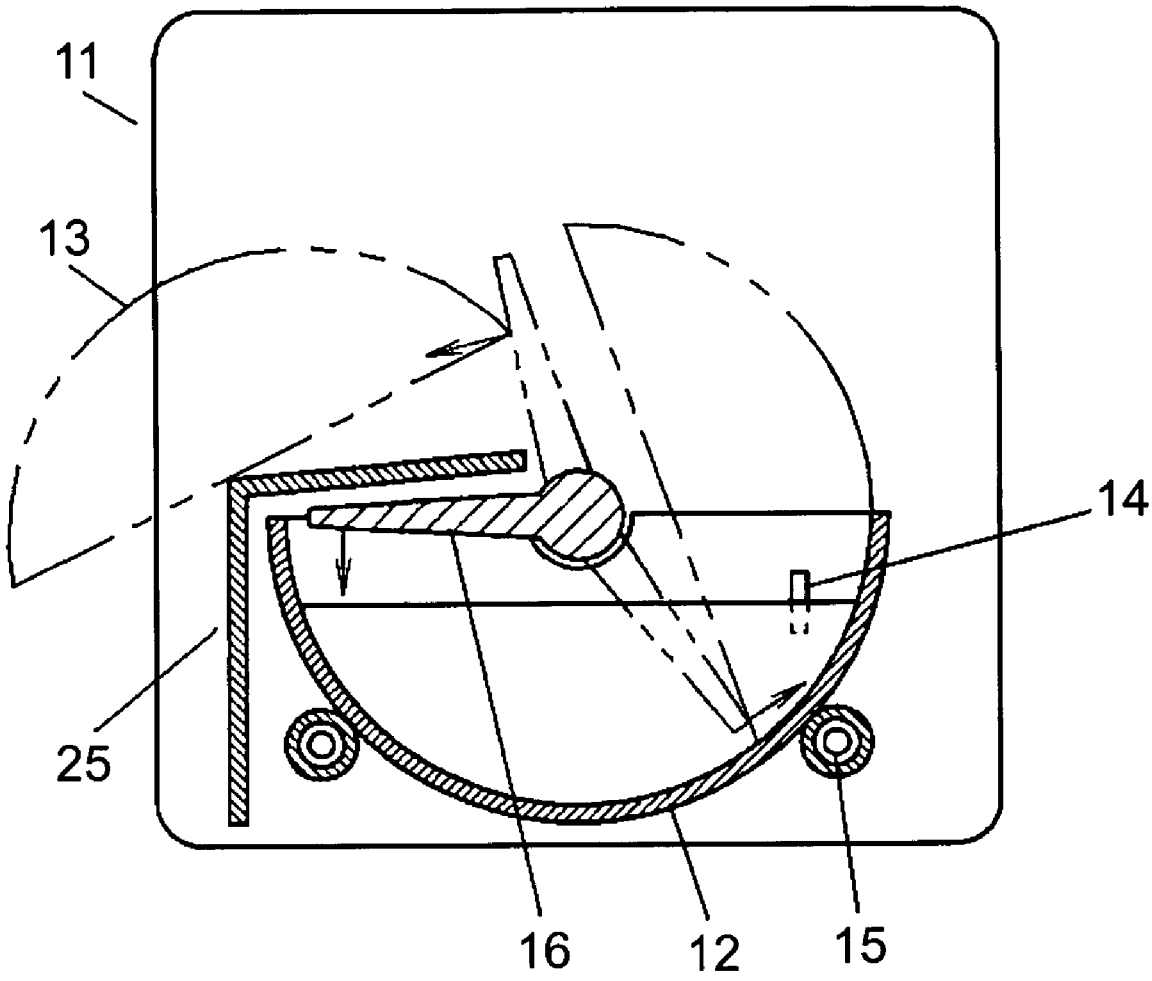
FIG. 1 is a cross sectional view of an essential part of an ice making unit of the automatic ice making device in an embodiment of the invention.
Figure 2:
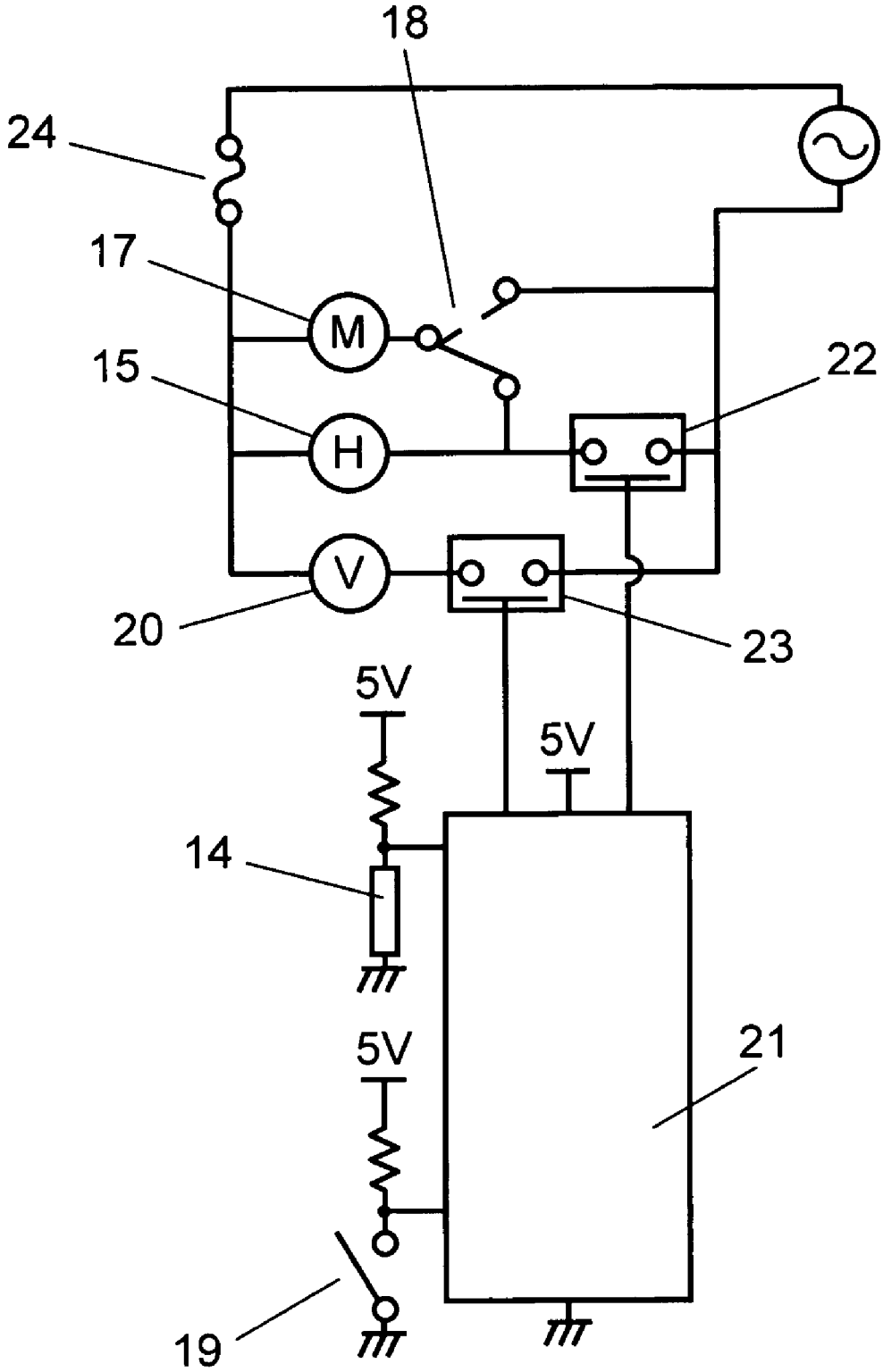
FIG. 2 is a block diagram of an essential part of an ice making unit of the automatic ice making device in the same embodiment.
Figure 3:
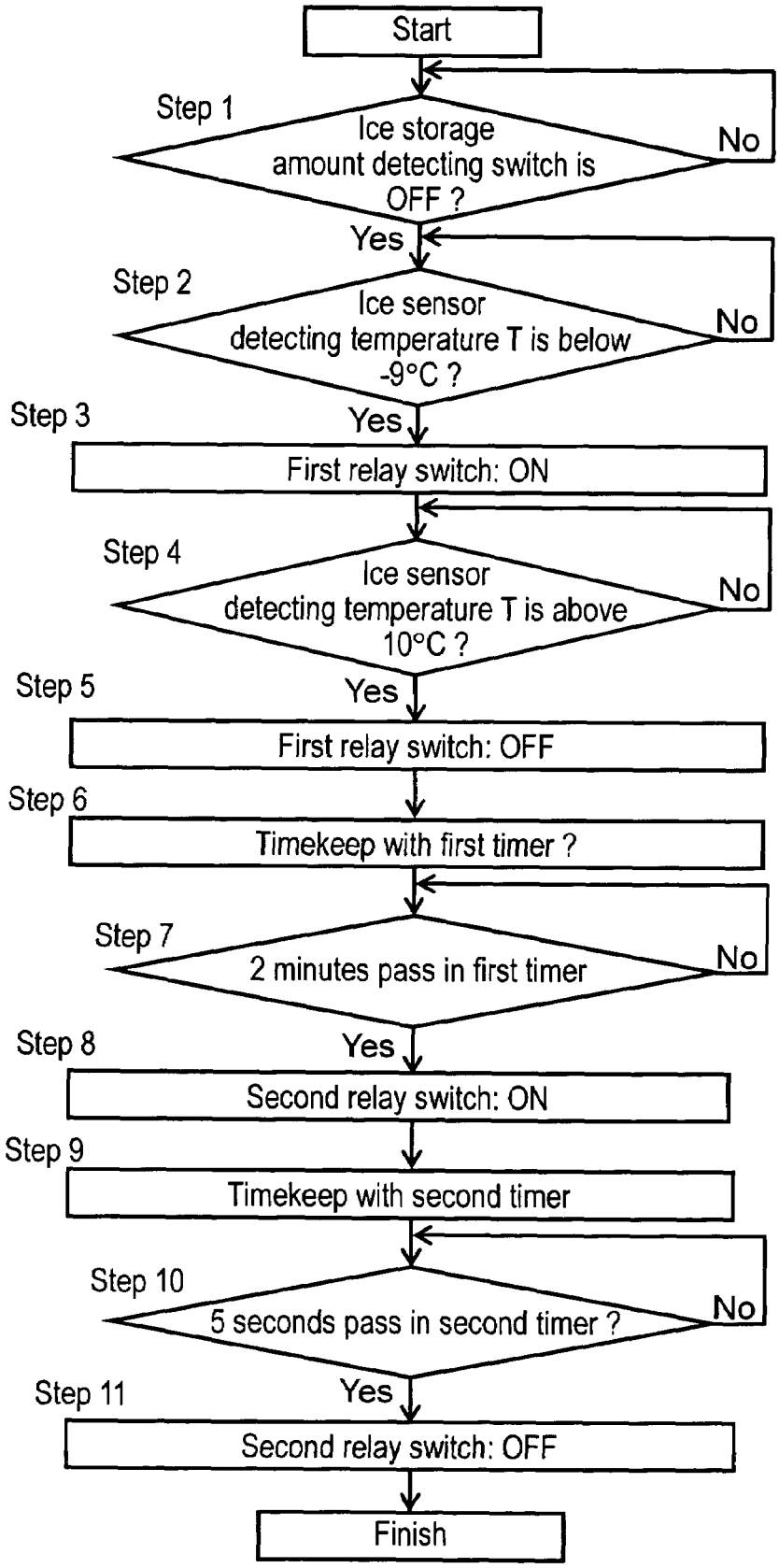
FIG. 3 is a working flow chart in the same embodiment.
Figure 4:
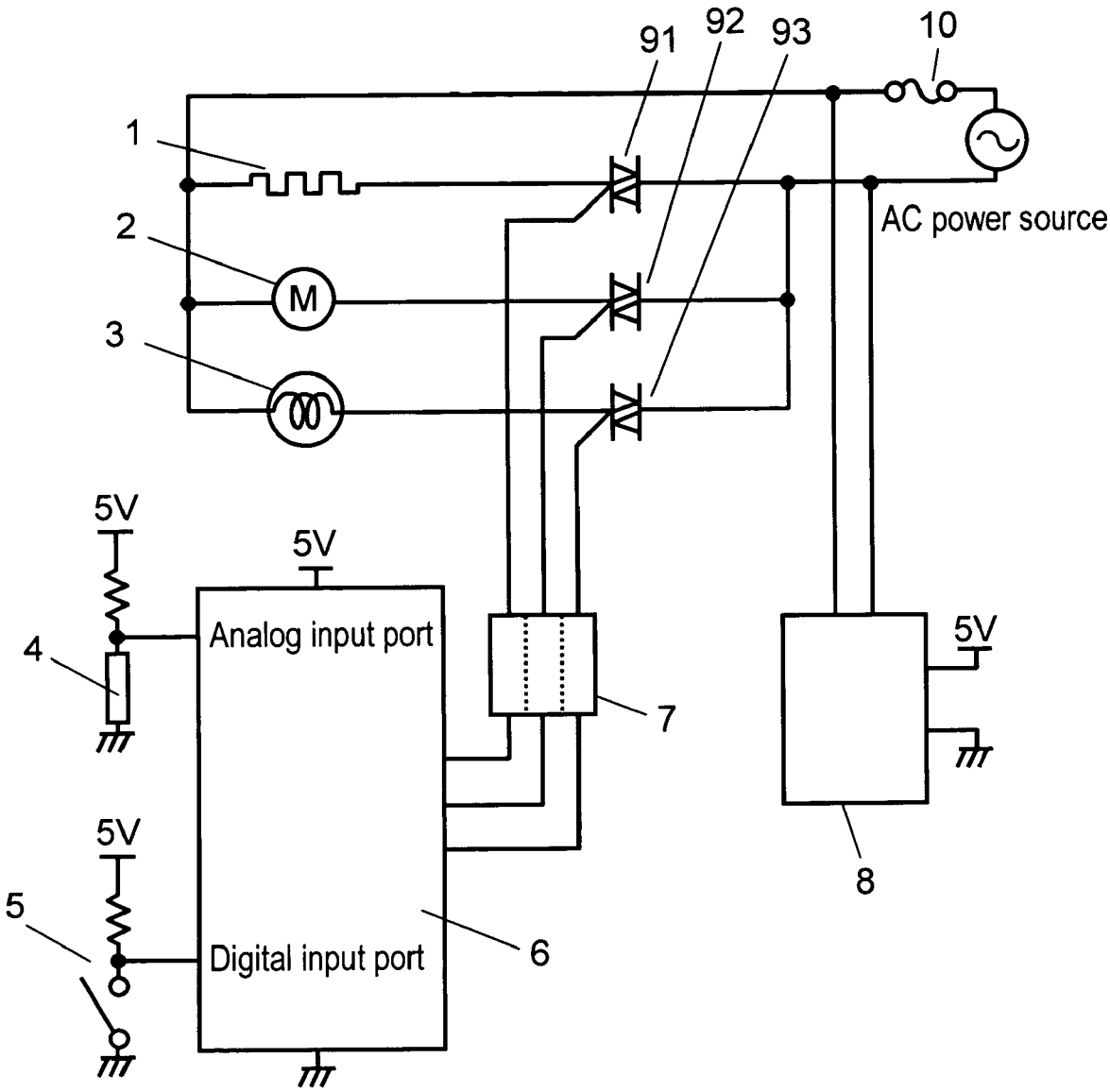
FIG. 4 is a system-block diagram of the conventional automatic ice making device.

FIG. 1 is the cross sectional view of an essential part of the ice making unit of the automatic ice making device by the embodiment 1 of the invention. FIG. 2 is the block diagram of an essential part of the ice making unit of the automatic ice making device in the same embodiment. FIG. 3 is the working flow chart of the ice making unit of the automatic ice making device in the same embodiment.

Ice making unit 11 has ice chill tray 12, ice sensor 14, heater 15, discharging member 16, motor 17, position detecting switch 18 and ice storage amount detecting switch 19.

Ice sensor 14 includes the thermistor of detecting temperature of the ice chill tray. Heater 15 is equipped at a place enabling to heat ice chill tray 12 for separating ice 13, and in this embodiment, it is placed under an outside bottom of ice chill tray 12.

Motor 17 is worked by AC power. Motor 17 rotates discharging member 16. Position detecting switch 18 detects rotating position of discharging member 16. Position detecting switch 18 is turned OFF at a waiting position.

Ice storage amount detecting switch 19 detects that ice is stored more than a predetermined amount in an ice box (not shown) under ice chill tray 12. Water supply valve 20 is worked by AC power, and opens and closes a water supply path.

Heater 15 and motor 17 are electrically supplied via first relay switch 22. Water supply valve 20 is electrically supplied via second relay switch 23. Controller 21 controls ON/OFF of first relay switch 22 and second relay switch 23 in response to a signal from ice sensor 14.

Fuse 24 works when the ice chill tray is over heated. Guide plate 25 is structured to causes ice to slide thereon and drop into a lower part of ice chill tray 12.

As to the automatic ice making device composed above mentioned, the workings will be referred to by use of the flow chart of FIG. 3.

At Step 1, when controller 21 detects OFF of ice storage amount detecting switch 19, it reads in output voltage of ice sensor 14 at Step 2. When detected temperature T goes down to −9° C. at Step 2, controller 21 turns ON first relay switch 22 at Step 3.

By turning ON first relay switch 22, electric power is supplied to heater 15 and motor 17, and motor 17 rotates. By rotation of motor 17, the discharging member contacts ice to exert ice 13 to get out from ice chill tray 12.

Ice chill tray 12 then heightens temperature by heater 15, and portion of ice contacting ice chill tray 12 starts to melt. Ice 13 thereby easily separates from ice chill tray 12.

Rotation of motor 17 stops when position detecting switch 18 for detecting rotating position of discharging member 16 is changed from ON to OFF.

At Step 4, controller 21 reads in output voltage of ice sensor 14, and when the detected temperature T goes above 10° C., first relay switch 22 is turned OFF at Step 5 to stop conduction to heater 15. The step advances to Step 6, and a first timer starts to count time.

At Step 7, when a counted time of the first timer passes more than 2 minutes, the step advances to Step 8, second relay switch 23 is turned ON to drive water supply valve 20, open the water supply path, and start to supply water to ice chill tray 12. Advancing to Step 9, the second timer starts to count time.

At Step 10, when the counted time S2 of the second timer passes 5 seconds, the step advances to Step 11 to turn OFF second relay switch 23. Accordingly, controller 21 drives water supply valve 20 only for 5 seconds and supplies water into the ice chill tray.

Through the above series of operations, one cycle of the ice-making work is completed. By repeating this cycle, the ice box is filled with ice. When ice in the ice box exceeds the predetermined amount, ice storage amount detecting switch 19 is turned ON, and the work stands ready at Step 1 to interrupt the ice-making.

In case the interruption of the power supply happens immediately after water in ice chill tray 12 is frozen, ice 13 in ice chill tray 12 becomes water. Thereafter, even when the electric source is recovered, the work is held waiting until the detected temperature T by ice sensor 14 goes down below −9° C. as shown in Step 2 and the following. That is, since water is supplied after the ice-making is completed and ice 13 is discharged, water is not supplied over again. There is no inconvenience of water overflowing from ice chill tray 12.

Since motor 17 is stopped by position detecting switch 18, a drive circuit is no longer necessary for driving motor 17 within controller 21. Since controller 21 has a simple structure for controlling only first relay switch 22 and second relay switch 23, reduction in cost can be attained.

As mentioned above, the automatic ice making device of the present invention can realize a series of ice-making cycle with the simple structure, has high reliability at low cost and can be applied as the automatic ice making device for the refrigerator.

What is claimed is:

1. An automatic ice making device, comprising:

an ice chill tray;

an ice sensor for detecting generation of ice in the ice chill tray;

a heater for heating the ice chill tray for separating ice from the ice chill tray;

a motor for rotating a discharging member for discharging ice separated from the ice chill tray;

a position detecting switch for detecting rotating position of the discharging member;

an ice storage amount detecting switch for detecting an amount of ice discharged from the ice chill tray and stored;

a water supply valve for supplying water to the ice chill tray; and a controller for controlling power supply to the motor and the heater, and controlling the water supply valve, wherein the controller drives the motor when the ice storage amount detecting switch detects that the amount of the stored ice is below a predetermined amount and the ice sensor detects temperature under a predetermined temperature; and wherein, when detecting a predetermined rotating position, the position detecting switch stops power supply to the motor.

2. The automatic ice making device as set forth in claim 1, further comprising:

a first relay switch for performing supply/stop of electric power to the motor and the heater; and a second relay switch for performing supply/stop of electric power for opening and closing the water supply valve, wherein the controller controls the second relay switch from opening to closing after a predetermined time passes from a time point when the first relay switch is controlled from closing to opening.

* * * * *

UNITED STATES PATENT AND TRADEMARK OFFICE

CERTIFICATE OF CORRECTION

PATENT NO. : 7,201,007 B2 
APPLICATION NO. : 11/013035
DATED : April 10, 2007
INVENTOR(S) : Masatoshi Shoukyuu et al.

It is certified that error appears in the above-identified patent and that said Letters Patent is hereby corrected as shown below:

Title Page
Add
-- (30) Foreign Application Priority Data
Dec. 24, 2003 (JP) .....2003-426829 --

Signed and Sealed this

Twenty-first Day of August, 2007

JON W. DUDAS
*Director of the United States Patent and Trademark Office*